US005498169A

United States Patent [19]

Ikemoto

[11] Patent Number: 5,498,169

[45] Date of Patent: Mar. 12, 1996

[54] FLEXIBLE CABLE CONNECTOR

[75] Inventor: Shinichi Ikemoto, Tokyo, Japan

[73] Assignee: Kel Corporation, Tokyo, Japan

[21] Appl. No.: 241,027

[22] Filed: May 10, 1994

[30] Foreign Application Priority Data

May 10, 1993 [JP] Japan ..... 5-132686

[51] Int. Cl.[6] ..... H01R 13/00

[52] U.S. Cl. ..... 439/260; 439/495

[58] Field of Search ..... 439/259, 260, 439/263, 264, 492–499, 910

[56] References Cited

U.S. PATENT DOCUMENTS

| | | | |
|---|---|---|---|
| 4,580,867 | 4/1986 | Wright et al. | 439/260 |
| 4,808,113 | 2/1989 | Kanesige et al. | 439/493 |
| 5,108,309 | 4/1992 | Oda et al. | 439/910 |
| 5,240,430 | 8/1993 | Soes | 439/260 |
| 5,308,262 | 5/1994 | Chishima | 439/495 |

FOREIGN PATENT DOCUMENTS

| | | |
|---|---|---|
| 3-266384 | 11/1991 | Japan . |
| 4-34880 | 2/1992 | Japan . |

*Primary Examiner*—Gary F. Paumen
*Assistant Examiner*—Hien D. Vu
*Attorney, Agent, or Firm*—Robert W. J. Usher

[57] ABSTRACT

A connector comprises a housing having a cable receiving cavity with a cable admitting mouth; a row of contacts in the housing cavity, each having parallel arms providing between them a cable receiving gap adjacent the mouth, and a contact protuberance on one arm protruding into the gap adjacent the mouth; and a slider with a pressing portion extending along the cavity through the cable receiving gaps. The slider is movable between a cable admitting position remote from the mouth and a cable connecting position adjacent the mouth, forcing the cable into electrical connection with the protuberances.

13 Claims, 7 Drawing Sheets

Fig. 8
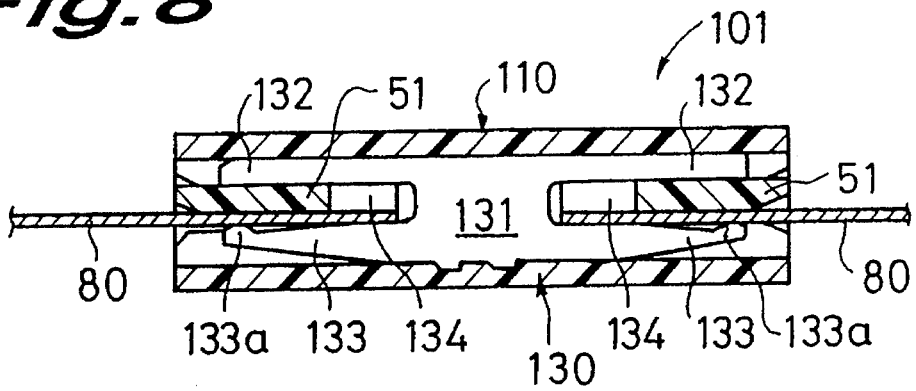
Fig. 10
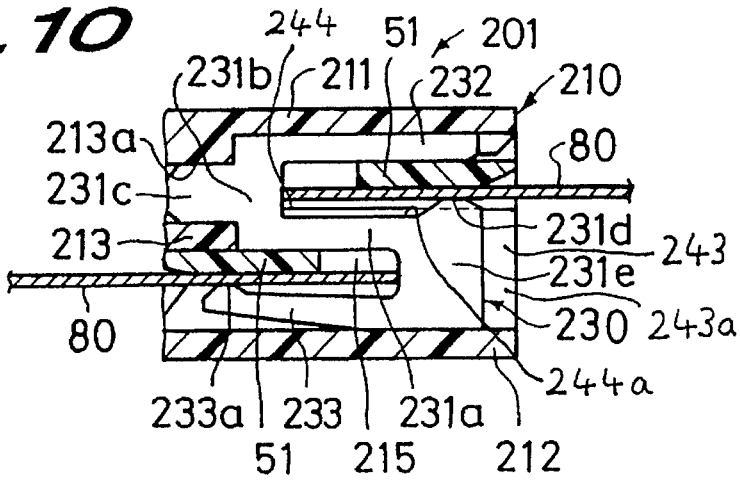
Fig. 11 (A)
(PRIOR ART)
Fig. 11 (B)
(PRIOR ART)
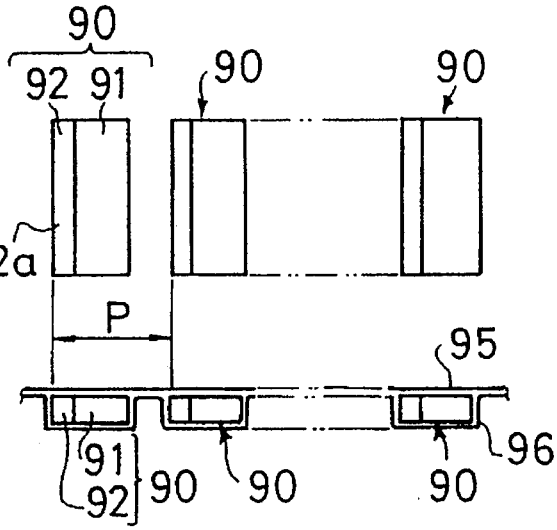

FLEXIBLE CABLE CONNECTOR

FIELD OF THE INVENTION

The invention concerns a flexible cable connector for effecting electrical connection to respective conductive paths on an end portion of a flexible cable, either for connection to a printed circuit board or to another flexible cable.

BACKGROUND OF THE INVENTION

Examples of prior flexible cable connectors shown in Japanese Patent Disclosure Bulletins Nos. 3-266384 and 4-34880, published on Nov. 27, 1991 and Feb. 5, 1992. As indicated diagrammatically in FIG. 11, the prior connectors comprise an insulating housing 91 each formed with a cable receiving cavity which opens at a cable admitting mouth to a front face and a series of contacts which are anchored in a row in the cavity and a slider 92 for reciprocal sliding movement in the housing towards and away from the cable receiving mouth between cable admitting and cable connecting positions.

In this type of connector 90, in the cable admitting position, the end of the flexible cable is inserted into the cable receiving cavity with the majority of the slider withdrawn from the cavity in front of the mouth; the slider is then pushed into the cable receiving cavity, pressing the flexible cable onto a protuberance on the contact, thereby connecting the respective conductive paths or layers thereof to respective contacts.

However, a disadvantage of the prior teachings is that although the majority of the slider is withdrawn in front of the mouth in the cable admitting position, an inner end of the slider remains in the mouth restricting the clearance so that it is not easy to insert the flexible cable.

Additionally, in the cable admitting position, as shown in FIG. 11, the outer end 92*a* of the slider 92 protrudes outwardly from the face of the insulating housing for handling by the fingers, causing a corresponding undesirable increase in the external dimensions of the connector, which is also particularly disadvantageous where, as shown in FIG. 11 (B), connectors of this type are commonly packaged for automatic feed on carrier strips formed by upper and lower webs 95 and 96, respectively, where the increase in size results in an undesirable increase in the required pitch.

Furthermore, in an attempt to minimize the package dimensions, the connectors are packaged with the inner end of the slider fully inserted into the cable receiving cavity. An additional handling step of withdrawing the slider to the cable admitting position is therefore required when the package is opened while the action of manually pulling out the slider introduces a risk of damage to the slider locking mechanism if pulled too strongly.

SUMMARY OF THE INVENTION

Objects of the invention are to provide a flexible cable connector which facilitates easy cable insertion and connection by the flexible cable connector, which can be of compact size, and which can be packaged in a position which permits insertion of the cable immediately after opening the package, without a requirement for an additional handling step.

According to one aspect, the invention provides a flexible cable connector for effecting electrical connection to respective conductive paths on an end portion of a flexible cable comprising an insulated housing having a cable receiving face and formed with an elongate, cable receiving cavity with a cable receiving mouth opening to the cable receiving face; a plurality of electrical contacts each having two elongate portions which extend side by side, spaced a predetermined distance apart to provide between them a cable receiving gap, at least one elongate portion of each contact being formed with a protuberance protruding towards a respective other elongate portion of a respective contact, the contacts being mounted in the housing in a row with respective elongate portions extending adjacent respective opposite sides of the cable receiving cavity and with respective gaps opening towards the cable receiving mouth and with at least the protuberance of each contact protruding into the cavity adjacent the mouth; an elongate slider having a central pressing portion and actuating portions at respective opposite ends thereof and means mounting the slider in the housing with the pressing portion extending along the cable receiving cavity through the gaps between respective elongate portions of each contact for reciprocal sliding movement towards and away from the cable receiving mouth between an open, cable admitting position in which the pressing portion is spaced inwardly from the contact protuberance to permit a flexible cable to be inserted through the mouth into the cable receiving cavity and gaps between the respective elongate portions and a closed, cable connecting position in which the pressing portion is adjacent the mouth to press respective conductive paths of inserted cable into engagement with respective protuberances to effect electrical connection therewith.

As the slider is remote from the cable receiving mouth in the cable admitting position, the slider does not obstruct the mouth or otherwise impede entry of the end of the flexible cable into the cavity, facilitating easy assembly with the cable. In addition, as the slider is located within the cavity in both cable admitting and cable connecting positions, the overall size of the connector is not materially increased by the presence of the slider, providing a compact structure. Furthermore, as the external dimensions of the connector are essentially the same, irrespective of the position of the slider, the connector can be packaged with the slider in the open position ready to receive the cable immediately the package is opened eliminating both the additional handling step and the risk of consequential damage to the slider.

More particularly, each contact includes a base portion from which the elongate portions extend, the said at least one elongate portion formed with the protuberance comprises a resilient arm which is resiliently flexed by the engagement with the respective conductive paths of the flexible cable.

Preferably, the housing is molded in one piece from plastic and is formed with upper and lower sidewalls spaced apart so as to define the cavity between them with the cavity opening to respective opposite longitudinal ends of the housing and the sidewalls are formed at locations adjacent and spaced from respective opposite ends with slots extending away from the cable receiving face so as to define resilient slider mounting arms at respective opposite longitudinal ends, which mounting arms have one of over-ridable indent and detent means for releasably latching the slider in respective open and closed positions.

Desirably, the housing is formed with upper and lower sidewalls spaced apart so as to define the cavity between them and a cable inspection window is formed in at least one sidewall at a location remote from the mouth to permit visual inspection of a cable received in the cavity when the slider is in the closed position thereby ensuring reliable electrical connection.

According to another aspect of the invention, there is provided a flexible cable connector for effecting electrical connection to respective conductive paths on respective end portions of first and second flexible cables comprising an elongate insulating housing having first and second, oppositely directed, cable receiving faces and formed with first and second, elongate cable receiving cavities with respective cable receiving mouths opening to the respective cable receiving faces and with a row of contact receiving sockets extending along the housing between the cable receiving cavities so that each socket communicates with both cable receiving cavities; a plurality of electrical contacts each having a base portion and first and second pairs of arms, the arms of each pair extending in side by side relation, spaced a predetermined distance apart to provide between them a cable receiving gap, the first and second pairs of arms extending from respective opposite sides of the base portion and at least one arm of each pair of arms being formed adjacent a free end thereof with a protuberance protruding towards a respective other arm portion of that pair, the contacts being mounted in the housing in a row with respective base portions in respective contact receiving sockets and respective arms of the first and second pairs extending adjacent respective opposite sides of the first and second cable receiving cavities, respectively, and with respective cable receiving gaps opening towards respective cable receiving mouths and with at least the protuberances of each contact protruding into the respective cavities adjacent the respective mouths; first and second elongate sliders each having a central pressing portion and actuating portions at respective opposite ends thereof and means mounting the first and second sliders in the housing with the respective pressing portions extending along the first and second cable receiving cavities, respectively, and through the respective gaps between respective arms of the first and second pairs of arms, respectively, for reciprocal sliding movement towards and away from the first and second cable receiving mouths, respectively, between open, cable admitting positions in which the respective pressing portions are spaced inwardly from the protuberances to permit respective flexible cables to be inserted through the first and second mouths, respectively, into the first and second cable receiving cavities, respectively, and into the gaps between the first and second pairs of arms, respectively, and a closed, cable connecting position in which the pressing portions are adjacent respective mouths to press respective conductive paths of inserted cables into engagement with respective protuberances to effect electrical connection therewith.

This construction enables cables to be spliced together in line, quickly and easily. Inspection windows may be formed in walls of both cavities enabling the insertion depth of the cables to be visually checked when the slider is in the open position.

According to a further aspect of the invention, there is provided a flexible cable connector for effecting electrical connection to respective conductive paths on respective end portions of first and second flexible cables comprising an elongate insulating housing having first and second, oppositely directed, cable receiving faces and formed with first and second, upper and lower, elongate, intercommunicating, cable receiving cavity portions, having respective cable admitting mouths opening at upper and lower locations of respective cable receiving faces; a plurality of electrical contacts of substantially S-shape having upper, medial and lower arm portions extending in side by side relation with the upper and lower arm portions extending spaced a predetermined distance apart and in opposite directions from respective opposite ends of the medial arm portion to define therewith upper and lower cable receiving gaps, respectively, of predetermined width, at least one arm being formed with first and second protuberances extending from locations adjacent respective cable admitting mouths into respective gaps and towards the respective other arms, the contacts being mounted in the housing in a row with respective arms extending between respective cable receiving faces and the upper and lower cable receiving gaps substantially aligned with upper and lower cable receiving cavity portions, respectively, and opening to upper and lower cable admitting mouths and with the protuberances protruding into upper and lower cable receiving cavity portions respectively adjacent the mouths; first and second elongate sliders each having a central pressing portion and actuating portions at respective opposite ends thereof and means mounting the first and second sliders in the housing one above the other with the pressing portions extending along the upper and lower cable receiving cavities, respectively, and through the upper and lower cable receiving gaps, respectively, for reciprocal sliding movement towards and away from the upper and lower cable receiving mouths, respectively, between open, cable admitting positions in which the respective pressing portions are spaced inwardly from the protuberances to permit respective flexible cables to be inserted through the upper and lower cable admitting mouths, respectively, into the upper and lower cable receiving cavities, respectively, and into the upper and lower cable receiving gaps, respectively, and a closed, cable connecting position in which the pressing portions are adjacent respective cable admitting mouths to press respective conductive paths of inserted cables into engagement with respective protuberances to effect electrical connection therewith.

As the cable receiving cavity portions are located one above the other, a connector of less width can be obtained.

According to an additional aspect of the invention, there is provided a flexible cable connector for effecting electrical connection to respective conductive paths on an end portion of a flexible cable comprising an elongate insulating housing having a first cable receiving face and formed with an elongate, cable receiving cavity with a cable receiving mouth opening to the cable receiving face, the cavity having opposite sidewalls extending away from the cable receiving mouth; a plurality of electrical contacts each comprising an arm having a protuberance adjacent a free end, the contacts being mounted in the housing in a row with respective protuberances adjacent the mouth and spaced a predetermined distance apart from one sidewall, and with respective arms extending across the cavity, inwardly away from the mouth; an elongate slider having a central pressing portion and actuating portions at respective opposite ends thereof and means mounting the slider in the housing with the pressing portion extending along the cable receiving cavity for reciprocal sliding movement towards and away from the cable receiving mouth between an open, cable admitting position in which the pressing portion is spaced inwardly, remote from the mouth and contact protuberance to permit an end of a flexible cable to be inserted through the mouth into the cable receiving cavity and between the respective protuberances and the one sidewall and a closed, cable connecting position in which the pressing portion is adjacent the mouth urging the end of an inserted cable and the protuberances relatively together to bring respective conductive paths thereof into electrical engagement with respective contacts.

Specific embodiments of the invention will now be described by way of example only and with reference to the accompanying drawing in which:

FIG. 8 is a cross sectional view of the second embodiment interconnecting the ends of two flexible cables;

FIG. 10 is a cross sectional view of the second embodiment interconnecting the ends of flexible cable; and FIGS. 11A and 11B are schematic plan and elevational views showing the packaging of a conventional flexible cable connector.

DESCRIPTION OF PARTICULAR EMBODIMENTS

Figure 1:
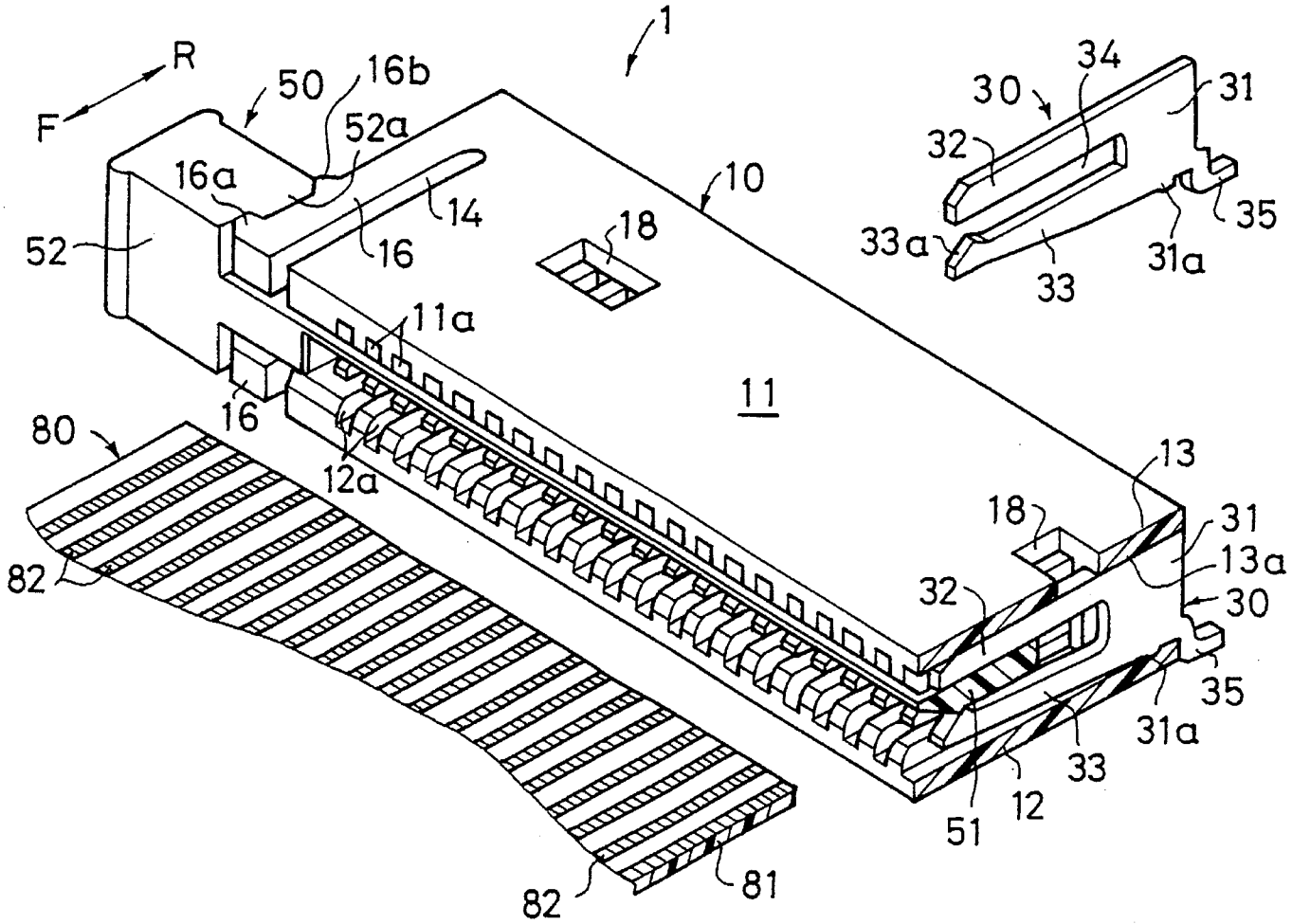
FIG. 1 is a perspective view, partly cut away and exploded, showing a first embodiment of flexible cable connector according to the invention and a flexible cable for connection thereto.

As shown in FIGS. 1–6, the first embodiment of flexible cable connector 1, consists of an elongate housing 10 molded in one piece of insulating plastic; a series of contacts 30, each stamped and formed from a single piece of sheet metal stock and arranged in a row along the insulating housing 10; and a slider 50, installed in the insulating housing 10 for reciprocal sliding movement in the directions of arrows F and R, shown in FIG. 1.

Figure 2:
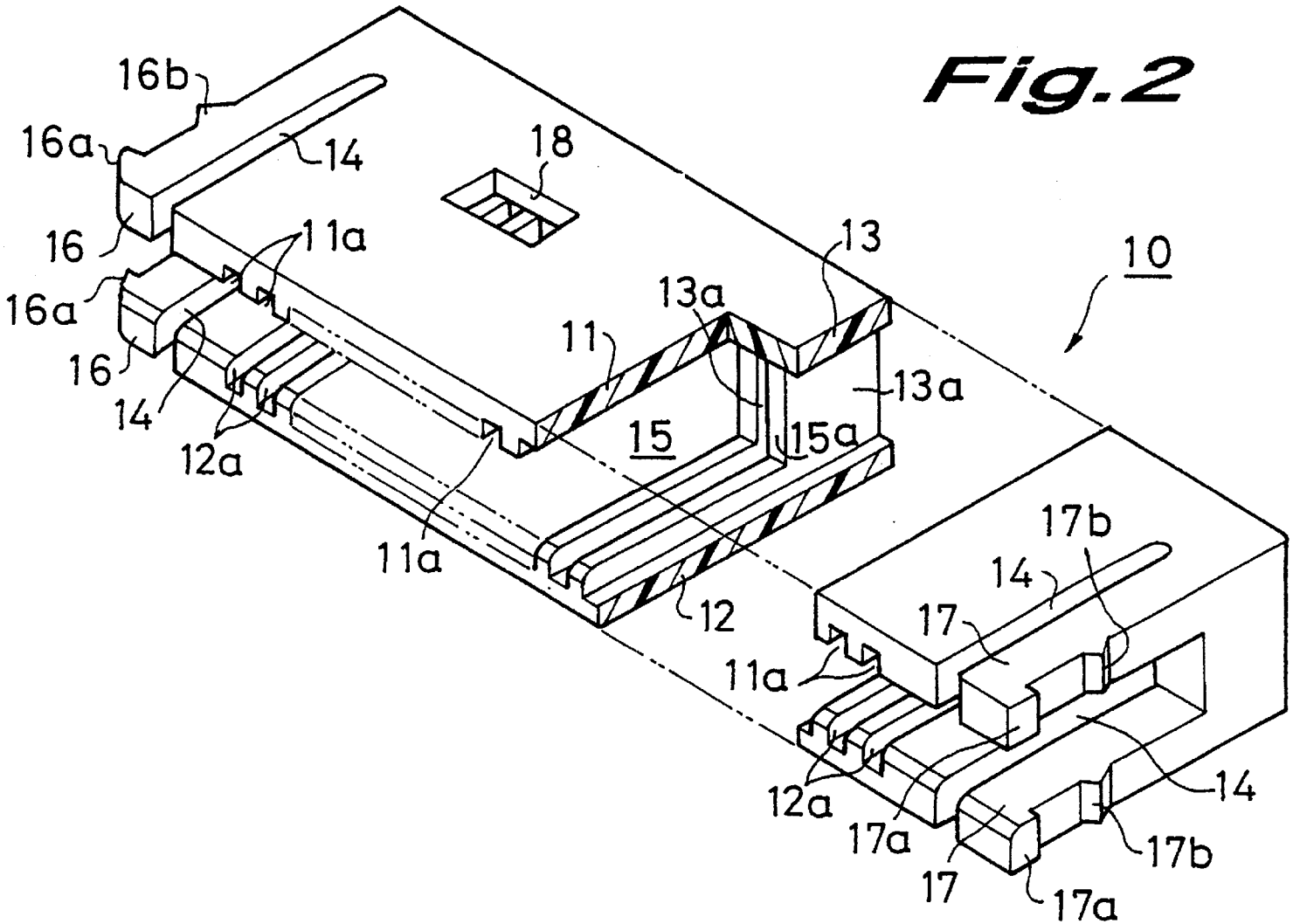
FIG. 2 is a perspective view, partly cut away showing the insulating housing of the connector of FIG. 1.

As shown in detail in FIG. 2, the insulating housing 10, is of substantially rectangular shape, formed by an upper sidewall 11 and a lower sidewall 12, joined by a rear wall 13, defining between them a longitudinally extending, cable receiving cavity 15 which opens both to a front, cable receiving face, at a cable receiving mouth, and to respective opposite longitudinal ends of the housing. Rows of upper and lower, aligned contact holding grooves 11*a* and 12*a* are formed in the inner surfaces of the upper and lower sidewalls (forming the walls of the cable receiving cavity), each groove extending between the cable admitting mouth and the rear wall 13 and communicating with a corresponding row of contact anchoring through sockets 13*a* extending from the cable receiving cavity to a rear face of the housing.

The sidewalls are formed at locations adjacent and spaced from respective opposite ends with slots 14 extending rearward away from the cable receiving face so as to define resilient slider mounting arms 16 and 17, respectively, at respective opposite longitudinal ends, which mounting arms have stop projections 16*a*, and 17*a* at front outer ends and over-ridable detent projections 16*b* and 17*b*, respectively, spaced rearward thereof by a predetermined distance for releasably latching the slider in respective open and closed positions.

Cable insertion inspection windows 18, extend through at least the upper sidewall 11 at longitudinally spaced intervals into the cable receiving cavity 15.

As shown in FIG. 1, each contact 30, is formed in one piece and comprises a plate-shape base or anchoring portion 31 from opposite (upper and lower) ends of a front edge portion of which, a pair of upper and lower arm portions 32, 33, extend in substantially parallel, coplanar relation and at a predetermined separation, providing a forwardly opening, cable-receiving gap 34 of predetermined width and of horizontal U-shape being enclosed by the base portion 31 and the upper and lower arm portions 32, 33. A lead portion 35 extends rearward from a bottom of a rear edge of the base portion 31. A contact protuberance 33*a* is formed on a free (front) end of the lower arm portion 33 and projects toward the upper arm portion 32. A small, downward projecting, insertion stopping protuberance or tooth 31*a* is formed on a bottom edge of the base portion 31.

Figure 4:
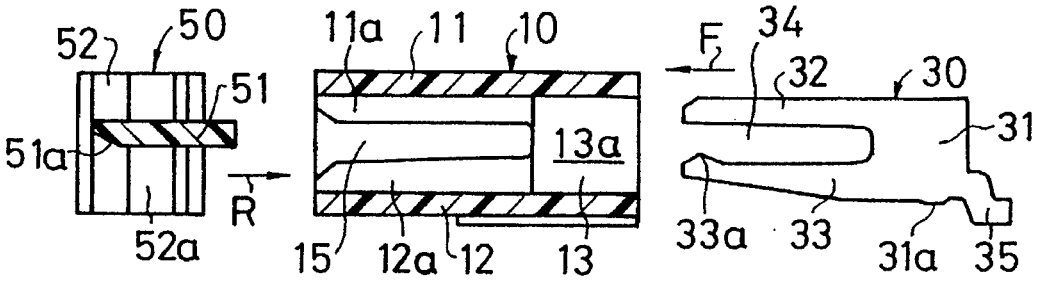
FIG. 4 is an exploded, cross sectional view of the component parts of the connector.

The contacts 30 are assembled with the housing by forcible insertion or stitching through the rear wall 13, as shown by the arrow F in FIG. 4, so that respective upper and lower arm portions 32 and 33, respectively, are received in respective upper and lower, contact holding grooves 11*a* and 12*a* and the respective base portions are received as interference or press fits in respective anchoring sockets 13*a* with the teeth 31*a* biting into the bottom walls of the sockets anchoring the contacts in position, so that the upper and lower arm portions 32 and 33 extend along upper and lower sidewalls and are located in the cable receiving cavity 15, opening towards the cable admitting mouth. The lead portions 35 then extend rearward and downward from the rear face of the insulating housing 10 for connection to a pcb 70 by a surface mount technique.

Figure 3:
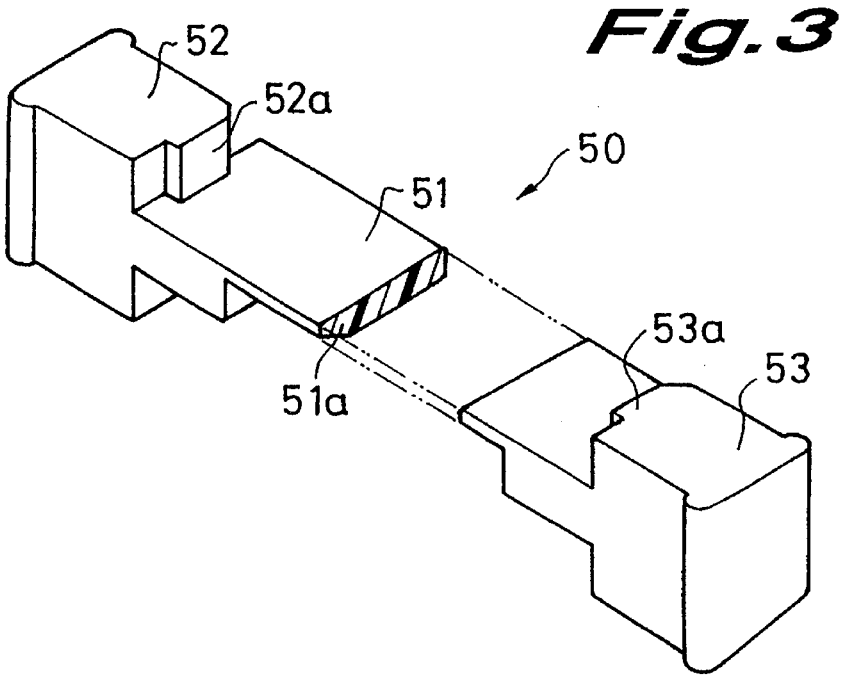
FIG. 3 is a perspective view, partly cut away, showing the slider of the connector of FIG. 1.

As shown in FIG. 3, the slider 50, is molded in one piece from insulating plastic with an elongate central pressing portion 51 of predetermined length and actuating portions 52 and 53 at respective opposite ends thereof. A tapered, lower leading edge 51*a* is formed on the front of the pressing portion 51, and positioning protuberances 52*a* and 53*a*, which protrude inwardly towards each other and face forwards are formed on opposed inner faces of the actuating portions 52, 53.

Figure 5:
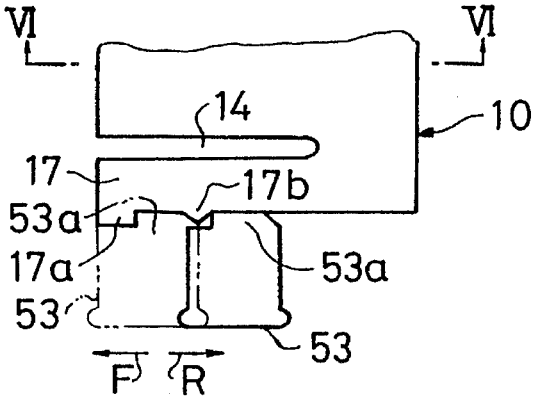
FIG. 5 is a fragmentary plan view of the connector of FIG. 1.

The slider 50 is assembled with the insulating housing 10 from the front face by receipt of the pressing portion 51 in the cable receiving cavity 15, as shown by arrow R in FIG. 4 while the positioning protuberances 52*a*, 53*a* of the actuating portions 52, 53, respectively are forced to ride over the stop protuberances 16*a* and 17*a* with resilient inward deformation of the resilient arms 16, As shown in FIG. 1, the positioning protuberances 52*a*, 53*a* are then retained between the stop protuberances 16*a*, 17*a* and the detent protuberances 16*b*, 17*b*, (as also by the chain line in FIG. 5). In this position, a rear portion of the pressing portion 51, is received in the gaps 34 of the contacts 30, and a medial portion of the pressing portion 51, is enclosed between the free, front ends of the upper and lower arm portions 32 and 33 of the contacts 30, which corresponds to the pressing position.

Figure 6:
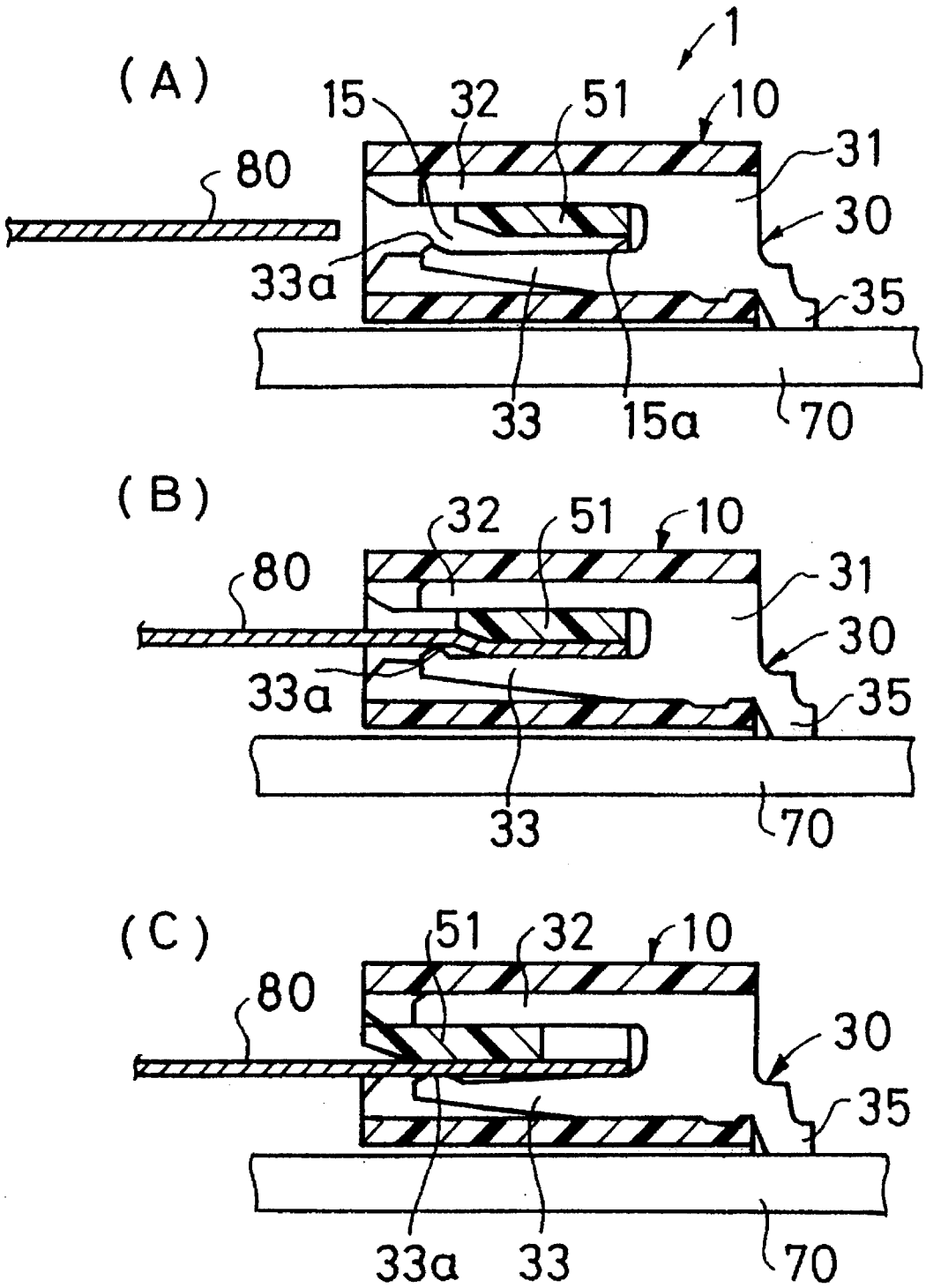
FIG. 6 (6A, 6B and 6C) are cross sectional views taken along line VI—VI of FIG. 5 showing the cable and connector at successive stages of insertion and connection.

Applying finger pressure to force the actuating portions 52, 53 rearward, causes the positioning protuberances 52*a*, 53*a* to ride over the detent protuberances 16*b*, 17*b* with momentary inward deformation of the mounting arms toward the remainder of the housing, and brings the rear, trailing edge of the pressing portion 51 into abutment with the rear wall 13 with the actuating portions 52, 53 held in this position (shown by the solid line in FIG. 5) by the resiling action of the detent protuberances. In this position the pressing portion 51 is in the cable admitting position being fully received in the cable receiving gaps of the contacts with the leading edge thereof remote from the protuberances 33*a* and the cable admitting mouth, as shown in FIG. 6 (A).

It is clear, therefore, that the slider can be reciprocated toward and away from the cable admitting mouth between cable admitting and connecting positions by application of finger pressure to the respective actuating portions overriding the detents 17*a* and 17*b* by resilient flexure of the mounting arms.

In FIG. 1, the elongate flexible cable 80 is shown positioned upside down, with the lower surface uppermost to reveal the conductive wiring pattern layer or conductive paths 82 thereon.

The connector 1 is installed, for example, on a printed circuit board 70 and the lead portions 35 of the connectors 30 are connected to the wiring pattern of the printed circuit board 70 by a known surface mount technique.

In assembling an end portion of the flexible cable with the connector, the slider 50 is placed in the open position shown in FIG. 6 (A), so that the pressing portion is withdrawn from the contact protuberances 33*a* and the cable admitting mouth permitting unobstructed insertion of the end of the cable 9 with the conductive paths lowermost, (opposite to the position shown in the figure), through the cable admitting mouth into the cable receiving cavity 15 to the position shown in FIG. 6 (B), in which the flexible cable 80 is received in the gaps of the contacts 30 under the pressing portion 51.

Visual confirmation that the end of the flexible cable 80 is completely inserted can be obtained by looking through the inspection window 18. To enable such inspection a cut out or rebate (not shown) is formed at a location of the slider which will align with the window. The actuating portions 52, 53 are then pushed forward to override the detents 17*a* and 17*b*, moving the pressing portion 51 toward the cable admitting mouth to the cable connecting portion, shown in FIG. 6 (C), in which it depresses the cable onto the contact protuberances 33*a* with a camming action, as a result of the tapered surface 51*a*, and is located over the contact protuberances 33*a* resulting in the respective conductive paths 82 being urged into engagement with the respective contact protuberances 33*a*, the resiliency of the lower arm portions 33 providing contact pressure. As a result, the contact protuberances 33*a* are electrically connected in a reliable manner with the corresponding wiring pattern layers 82.

As the slider is remote from the cable receiving mouth in the cable admitting position, the slider does not obstruct the mouth or otherwise impede entry of the end of the flexible cable into the cavity, facilitating easy assembly with the cable. In addition, as the slider is located within the cavity in both cable admitting and cable connecting positions, the overall size of the connector is not materially increased by the presence of the slider, providing a compact structure. Furthermore, as the external dimensions of the connector are essentially the same, irrespective of the position of the slider, the connector can be packaged with the slider in the open position, ready to receive the cable immediately the package is opened, eliminating both the additional handling step and the risk of consequential damage to the slider.

Figure 7:
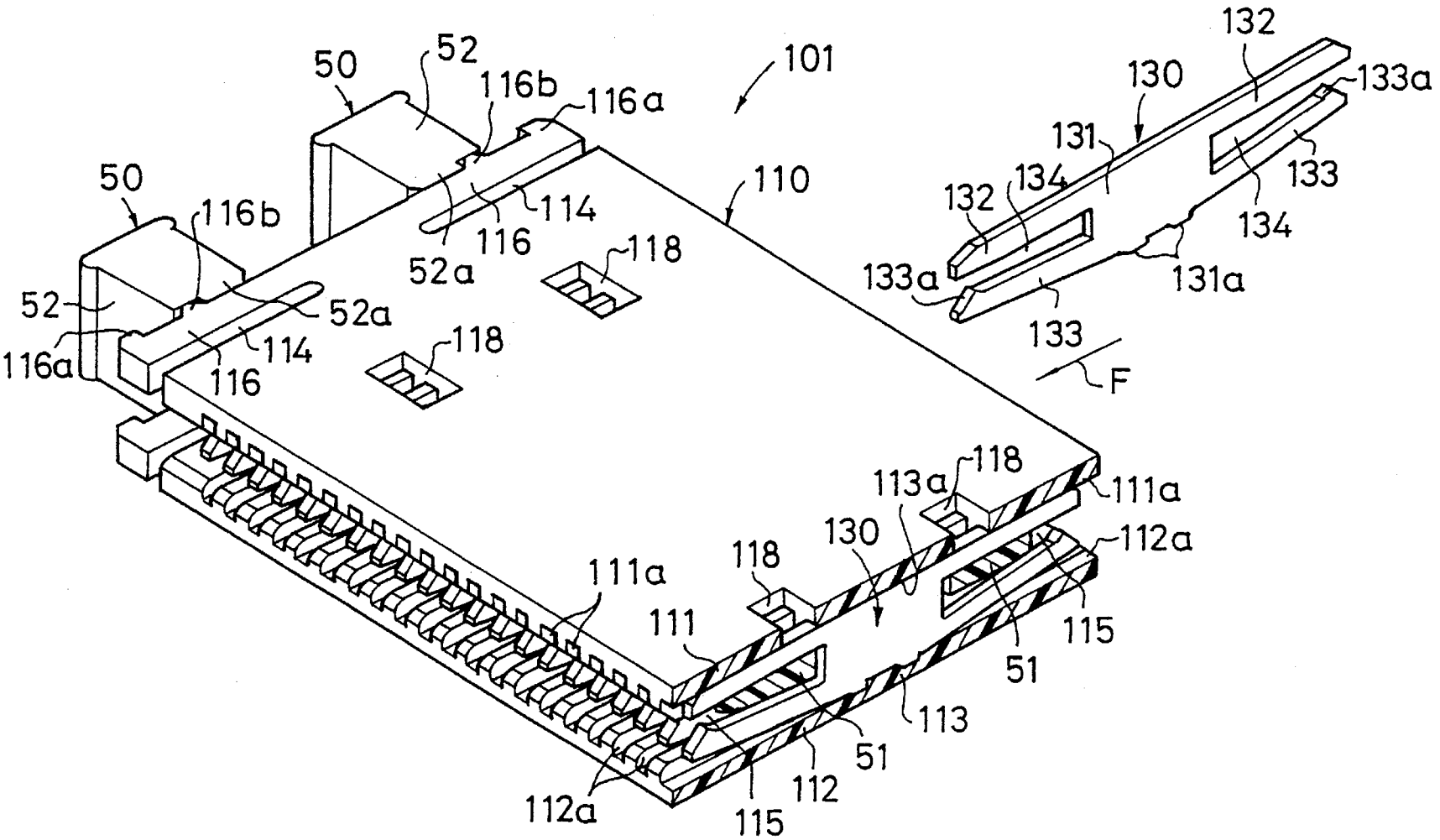
FIG. 7 is a perspective view, partly cut away and exploded, showing a second embodiment of flexible cable connector according to the invention and a flexible cable for connection thereto

The second embodiment of connector 101, shown in FIGS. 7 and 8 is essentially formed by two connectors of the first embodiment joined in back-to-back relation. Accordingly the connector 101 consists of an elongate housing 110 molded in one piece of insulating plastic; a series of contacts 130, each stamped and formed from a single piece of sheet metal stock and mounted in a row along the insulating housing 110; and a pair of sliders 50, installed in the insulating housing 10 for reciprocal sliding movement between cable admitting and cable connecting positions.

The insulating housing 110 has a substantially rectangular shape, formed by an upper sidewall 111 and a lower sidewall 112, joined by a central wall 113, defining between them first and second, longitudinally extending cable receiving cavities 115 which open to opposite, first and second, oppositely directed (front and rear) cable receiving faces at respective cable admitting mouths and to opposite longitudinal ends of the housing. Rows of upper and lower, aligned contact holding grooves 111*a* and 112*a* are formed in the inner surfaces of the upper and lower sidewalls (forming the walls of both cable receiving cavities), each groove extending between the respective cable admitting mouths and the central wall 113 in communication with opposite sides of a corresponding row of contact anchoring through sockets 113*a* extending through the central wall 113 between both cable receiving cavities.

The sidewalls are formed at locations adjacent and spaced from respective opposite ends with slots 114 extending rearward, away from both cable receiving faces to locations adjacent the central wall to define resilient slider mounting arms 116 and 117, (not shown), respectively, at respective opposite longitudinal ends, which mounting arms have stop projections 116*a* and 117*a* at front outer ends and overridable detent projections 116*b* and 117*b*, respectively, spaced rearward thereof by a predetermined distance for releasably latching the respective sliders in open and closed positions.

Cable insertion inspection windows 118, extend through at least the upper sidewall 111 at longitudinally spaced locations adjacent respective opposite sides of the central wall 115 into the cable receiving cavities 115.

Each contact 130, is formed in one piece and comprises a central plate-shape base or anchoring portion 131 from opposite (upper and lower) ends of front and rear edge portions of which, extend first and second pairs of upper and lower arm portions 132*a* and 133, respectively. In each pair, the arm portions extend in substantially parallel, coplanar relation and at a predetermined separation, providing a cable-receiving gap 134 of predetermined width and of horizontal U-shape, being enclosed by the base portion 131 and the upper and lower arm portions 132, 133 with the cable-receiving gaps 134 of the same contact opening in opposite directions. A contact protuberance 133*a* is formed on a free (front) end of the lower arm portion 133 of each pair and projects toward the upper arm portion 132. Small, downward projecting, insertion stopping protuberances or teeth 131*a* are formed on a bottom edge of the base portion 131.

The contacts 130 are assembled with the housing by forcible insertion or stitching through the rear cable admitting mouth, as shown by the arrow F in FIG. 7, so that respective upper and lower arm portions 132 and 133, respectively, are received in respective upper and lower, contact holding grooves 111*a* and 112*a* and the respective base portions 131 are received as interference or press fits in respective anchoring sockets 113*a* with the teeth 131*a* biting into the bottom walls of the sockets anchoring the contacts in position, so that the upper and lower arm portions 132 and 133 of the first and second pairs extend along upper and lower sidewalls and are located in respective first and second cable receiving cavities 115, and open towards the respective cable admitting mouth.

The two sliders 50 are each identical to the slider of the first embodiment and have therefore been assigned identical reference numerals, being assembled with the housing in similar fashion by forcible insertion through opposite cable receiving faces.

The assembly of the connector with end portions of flexible cables to provide an in-line splice, shown in FIG. 8, is carried out in similar fashion to that of the first embodiment. As before, with the respective sliders in the open, cable admitting positions, cable end portions are inserted through respective cable admitting mouths into respective cable receiving cavities and visual confirmation of complete insertion can be obtained through windows 118.

On movement of the sliders to the cable connecting position shown in FIG. 8, the pressing portions 51 presses the flexible cables 80 onto the contact protuberances 133*a*, forming a reliable electrical connection between the corresponding wiring pattern layers 82 of the two cables via the contact protuberances 133*a*.

Similar practical advantages accrue from the use of this embodiment as with the first embodiment.

Figure 9:
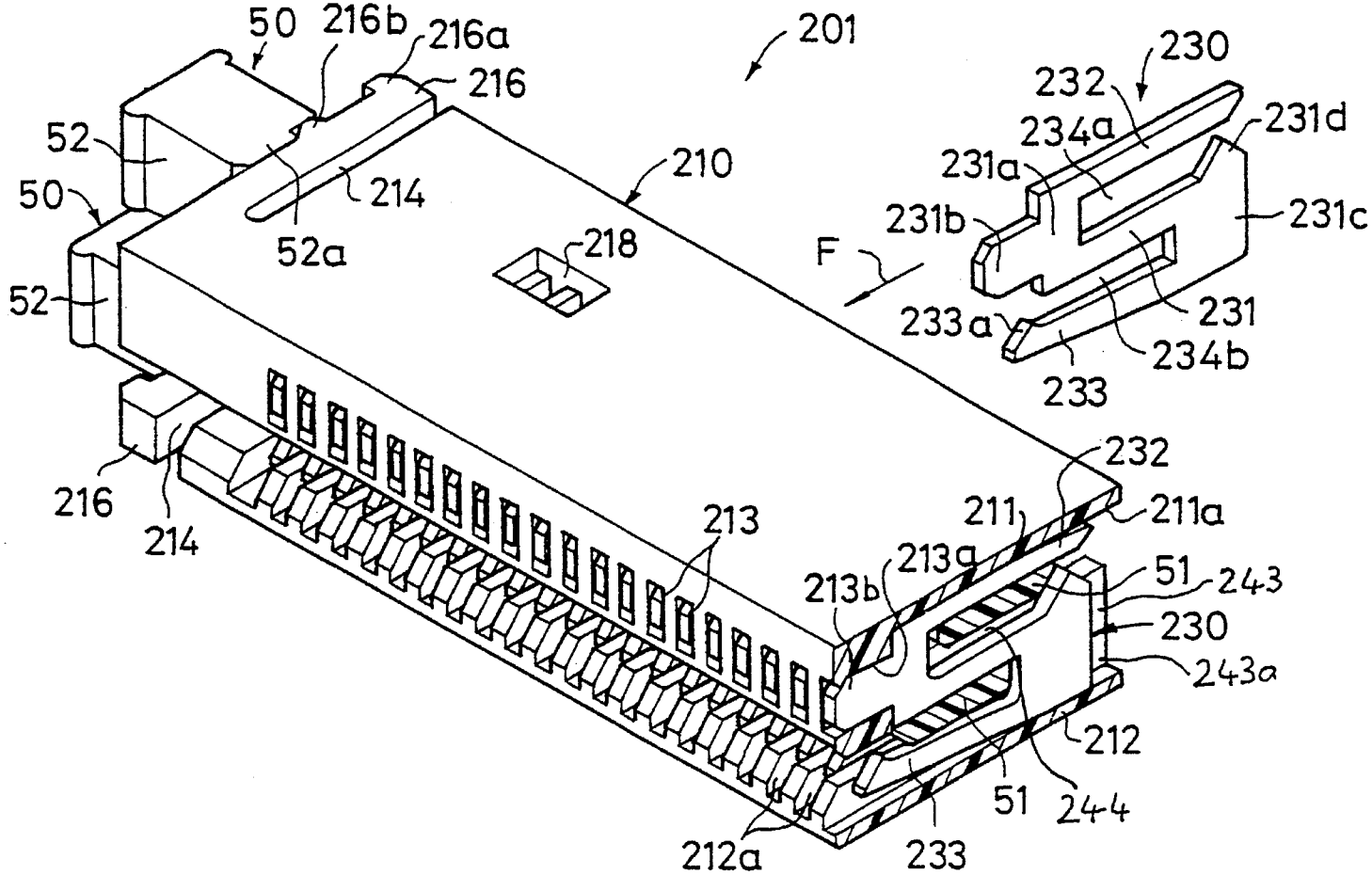
FIG. 9 is a perspective view, partly cut away and exploded, showing a third embodiment of flexible cable connector according to the invention and a flexible cable for connection thereto.

In a third embodiment, shown in FIG. 9, the connector 201 is of somewhat similar form to two connectors according to the first embodiment joined one above the other. Accordingly, the connector 201 consists of an elongate housing 210 molded in one piece of insulating plastic; a series of contacts 230, each stamped and formed from a single piece of sheet metal stock and mounted in a row along the insulating housing 210; and a pair of upper and lower sliders 50, installed in the insulating housing 10 for reciprocal sliding movement between cable admitting and cable connecting positions.

The insulating housing 210 has first and second, oppositely directed, cable receiving faces and is formed with first and second, upper and lower, elongate, intercommunicating, cable receiving cavity portions, having respective cable admitting mouths opening at upper and lower locations of respective cable receiving faces;

The insulating housing 210, is of substantially rectangular shape formed by an upper sidewall 211 and a lower sidewall 212, joined by an upper front wall 213, a lower rear wall 243 and a medial wall 244 extending between a lower end of the upper front wall 213 and an upper end of the lower rear wall, the walls defining between them upper and lower, elongate cable receiving cavity portions 215 having respective cable admitting mouths opening at lower and upper locations of respective cable receiving faces below and above front and rear walls 213 and 243, respectively and to respective opposite longitudinal ends of the housing.

Rows of upper and lower, aligned contact holding grooves 211*a* and 212*a* are formed in the inner surfaces of the upper and lower sidewalls, the grooves extending between the respective cable admitting mouths and contact anchoring through sockets 213*a* and 243*a* which are formed in the front and rear walls 213 and 243, respectively.

Contact receiving slots 244*a* also extend through the medial wall in communication with contact holding grooves 211*a*, 212*a* and contact anchoring through-sockets 213*a* and 243*a*.

The upper and lower sidewalls 211 and 212, respectively, are formed at locations adjacent and spaced from respective opposite ends with slots 214 extending rearward away from front and rear cable receiving faces, respectively, to locations adjacent the central wall to define upper and lower, resilient slider mounting arms 216 at respective opposite ends of the housing, which mounting arms have stop projections 216*a* free ends and over-ridable detent projections 216*b*, respectively, spaced rearward thereof by a predetermined distance for releasably latching the respective sliders in open and closed positions.

As in the earlier embodiment, upper and lower, rear and front cable insertion inspection windows 218, extend through upper and lower sidewalls 211 and 212 at longitudinally spaced locations adjacent respective front and rear walls 213 and 243, respectively, into the upper and lower cable receiving cavity portions 215.

The one-piece contacts 230*a* are each of substantially planar S-shape having upper, medial and lower arm portions 232, 231 and 233, respectively, extending in side by side relation with the upper and lower arm portions 232 and 231, respectively, extending spaced a predetermined distance apart and in opposite directions from respective opposite ends of the medial arm portion 231 to which they are joined by base portions 231*a* and 231*e*, respectively, defining upper and lower cable receiving gaps 234*a* and 234*b*, respectively, of predetermined width and of horizontal U-shape, opening in opposite directions. Ends of arm portions 231 at the join with base portion 231*c* and free end of arm portion 233 being formed with first and second protuberances 231*d* and 233*a*, respectively, adjacent the respective openings and extending into respective gaps and towards the respective arms 232 and 231, respectively. Anchoring portions 231*c* extend from respective base portions 231*b*.

The contacts 30 are assembled with the housing by forcible insertion or stitching through the rear wall 243, as shown by the arrow F in FIG. 9, so that respective upper and lower arm portions 232 and 233, respectively, are received in respective upper and lower, contact holding grooves 211*a* and 212*a* and the respective anchoring portions 231*c* of base portions 231*b* and respective base portions 231*e* are received as interference or press fits in respective anchoring through-sockets 213*a* and 243*a* with the medial arm portion 231 extending through the slots 244*a* in the medial wall. The respective cable receiving gaps are then aligned with the upper and lower cable receiving cavity portions and their respective openings aligned with the upper and lower mouths.

The two sliders 50 are each identical to the slider of the first and second embodiment and have therefore been assigned identical reference numerals, being assembled with the housing in similar fashion by forcible insertion through opposite cable receiving faces so that their pressing portions extend one above the other along respective upper and lower cable receiving cavity portions and between respect pairs of adjacent arm portions.

The assembly of the connector with end portions of flexible cables to provide a splice, shown in FIG. 10, is carried out in similar fashion to that of previously described embodiments. As before, with the respective sliders in the open, cable admitting positions, cable end portions are inserted through respective cable admitting mouths into respective upper and lower cable receiving cavity portions when visual confirmation of complete insertion can be obtained through windows 218.

On movement of the sliders to the cable connecting positions shown in FIG. 10, the pressing portions 51 presses the flexible cables 80 onto the contact protuberances 231*d* and 213*a*, forming a reliable electrical connection between the corresponding wiring pattern layers 82 of the two cables via the contact.

In addition, to the practical advantages accruing to the first two embodiments, as the sliders 50 are installed one above the other the width as measured between front and rear faces can be smaller decreasing the pitch for automatic tape feed.

The connector may also be formed so that the sliders are substantially completely within the housing and do not protrude significantly from respective end faces with only small actuating protuberances protruding from sides faces or above and below and which can be reciprocated by the fingers or a tool so as to decrease the length of the connector.

I claim:

1. A flexible cable connector for effecting electrical connection to respective conductive paths on an end portion of a flexible cable comprising:

an elongate insulating housing having a first cable receiving face and formed with an elongate, cable receiving cavity with a cable receiving mouth opening to the cable receiving face;

a plurality of electrical contacts each having two elongate portions which extend in side by side relation, spaced a predetermined distance apart to provide between them a cable receiving gap, at least one elongate portion of each contact being formed with a protuberance protruding towards a respective other elongate portion of a respective contact, the contacts being mounted in the housing in a row with respective elongate portions extending adjacent respective opposite sides of the cable receiving cavity and with respective gaps opening towards the cable receiving mouth and with at least the protuberance of each contact protruding into the cavity adjacent the mouth;

an elongate slider having a central pressing portion and actuating portions at respective opposite ends thereof and retaining means mounting the slider in the housing with the pressing portion extending along the cable receiving cavity through the gaps between respective elongate portions of each contact for reciprocal sliding movement towards and away from the cable receiving mouth between an open, cable admitting position in which the pressing portion is spaced inwardly, remote from the mouth and contact protuberance to permit a flexible cable to be inserted through the mouth into the cable receiving cavity and gaps between the respective elongate portions, and a closed, cable connecting position in which the pressing portion is adjacent the mouth to press respective conductive paths of the inserted cable into engagement with respective protuberances to effect electrical connection therewith, the central pressing portion of the slider remaining wholly within the housing cavity in both the cable admitting and cable pressing positions and throughout the sliding movement therebetween.

2. A flexible cable connector according to claim 1 wherein each contact includes a mounting portion from which the elongate portions extend, and the said at least one elongate portion formed with the protuberance comprises a resilient arm which is resiliently flexed by the engagement with a respective conductive path of the flexible cable.

3. A flexible cable connector according to claim 2 wherein the housing is molded in one piece from plastic and is formed with upper and lower sidewalls spaced apart so as to define the cavity between them with the cavity opening to respective opposite longitudinal ends of the housing and the sidewalls are formed at locations adjacent and spaced from respective opposite ends with slots extending away from the cable receiving face so as to define resilient, slider mounting arms at respective opposite longitudinal ends, which mounting arms have one of over-ridable indent and detent means for releasably latching the slider in respective open and closed positions.

4. A flexible cable connector according to claim 1 wherein housing is formed with upper and lower sidewalls spaced apart so as to define the cable receiving cavity between them and a cable inspection window is formed in at least one sidewall at a location remote from the mouth to permit visual inspection of a cable received in the cavity when the slider is in the open position.

5. A flexible cable connector for effecting electrical connection to respective conductive paths on respective end portions of first and second flexible cables comprising:

an elongate insulating housing having first and second, oppositely directed, cable receiving faces and formed with first and second, elongate cable receiving cavities with respective cable receiving mouths opening to the respective cable receiving faces and with a row of contact receiving sockets extending along the housing between the cable receiving cavities so that each socket communicates with both cable receiving cavities;

a plurality of electrical contacts each having a mounting portion and first and second pairs of arms extending from respective opposite sides thereof, the arms of each pair extending in side by side relation, spaced a predetermined distance apart to provide between them a cable receiving gap and at least one arm of each pair of arms being formed adjacent a free end thereof with a protuberance protruding towards a respective other arm portion of that pair, the contacts being mounted in the housing in a row by receipt of respective mounting portions in respective contact receiving sockets and respective arms of the first and second pairs extending adjacent respective opposite sides of the first and second cable receiving cavities, respectively, and with respective cable receiving gaps opening towards respective cable receiving mouths and with at least the protuberances of each contact protruding into the respective cavities adjacent the respective mouths;

first and second elongate sliders each having a central pressing portion and actuating portions at respective opposite ends thereof and means mounting the first and second sliders in the housing with the respective pressing portions extending along the first and second cable receiving cavities, respectively, and through the respective gaps between respective arms of the first and second pairs of arms, respectively, for reciprocal sliding movement towards and away from the first and second cable receiving mouths, respectively, between open, cable admitting positions in which the respective pressing portions are spaced inwardly from the protuberances to permit respective flexible cables to be inserted through the first and second mouths, respectively, into the first and second cable receiving cavities, respectively, and into the gaps between the first and second pairs of arms, respectively, and a closed, cable connecting position in which the pressing portions are adjacent respective mouths to press respective conductive paths of inserted cables into engagement with respective protuberances to effect electrical connection therewith, the central pressing portion of the slider remaining wholly within the housing cavity in both the cable admitting and cable pressing positions and throughout the sliding movement therebetween.

6. A flexible cable connector according to claim 5 wherein each of the said at least one arm formed with a protuberance is resilient and is resiliently flexed by the engagement with a respective, conductive path of the flexible cable.

7. A flexible cable connector according to claim 6 wherein the housing is molded in one piece from plastic and is formed with upper and lower sidewalls spaced apart so as to define the respective cavities between them with the cavities opening to respective opposite longitudinal ends of the housing and the sidewalls are formed at locations adjacent and spaced from respective opposite ends with slots extending away from the respective cable receiving faces so as to define resilient, slider mounting arms at respective opposite longitudinal ends, which mounting arms have one of overridable indent and detent means for releasably latching the respective sliders in respective open and closed positions.

8. A flexible cable connector according to claim 6 wherein housing is formed with upper and lower sidewalls spaced apart so as to define the first and second cavities between them and cable inspection windows are formed in at least one sidewall at locations remote from respective cable receiving mouths to permit visual inspection of cables inserted therein when the sliders are in the closed condition.

9. A flexible cable connector for effecting electrical connection to respective conductive paths on respective end portions of first and second flexible cables comprising:

an elongate insulating housing having first and second, oppositely directed, cable receiving faces and formed with first and second, upper and lower, elongate, cable receiving cavity portions, having respective cable admitting mouths opening at upper and lower locations of respective cable receiving faces;

a plurality of electrical contacts of substantially S-shape having upper, medial and lower arm portions extending in side by side relation with the upper and lower arm portions extending spaced a predetermined distance apart and in opposite directions from respective opposite ends of the medial arm portion to define therewith upper and lower cable receiving gaps, respectively, of predetermined width, at least one arm being formed with first and second protuberances extending from locations adjacent respective cable admitting mouths into respective gaps and towards respective other arms, the contacts being mounted in the housing in a row with respective arms extending between respective cable receiving faces and the upper and lower cable receiving gaps substantially aligned with upper and lower cable receiving cavity portions, respectively, and opening to upper and lower cable admitting mouths and with the protuberances protruding into upper and lower cable receiving cavity portions respectively adjacent the mouths;

first and second elongate sliders each having a central pressing portion and actuating portions at respective opposite ends thereof and retaining means mounting the first and second sliders in the housing one above the other with the pressing portions extending along the upper and lower cable receiving cavities, respectively, and through the upper and lower cable receiving gaps, respectively, for reciprocal sliding movement towards and away from the upper and lower cable receiving mouths, respectively, between open, cable admitting positions in which the respective pressing portions are spaced inwardly from the protuberances to permit respective flexible cables to be inserted through the upper and lower cable admitting mouths, respectively, into the upper and lower cable receiving cavities, respectively, and into the upper and lower cable receiving gaps, respectively, and a closed, cable connecting position in which the pressing portions are adjacent respective cable admitting mouths to press respective conductive paths of inserted cables into engagement with respective protuberances to effect electrical connection therewith, the central pressing portion of the slider remaining wholly within the housing cavity in both the cable admitting and cable pressing positions and throughout the sliding movement therebetween.

10. A flexible cable connector according to claim 9 wherein the insulating housing comprises an upper sidewall and a lower sidewall joined by an upper, front wall at the first face and a lower rear wall at the second face and a medial wall extending between a lower end of the upper front wall and an upper end of the lower rear wall so that the first, upper cavity portion is defined between the upper sidewall, the upper, front wall, and the medial wall and the second, lower cavity portion is defined between the lower sidewall, the lower, rear wall and the medial wall, and slots receiving respective medial arms of respective contacts extend through the medial wall in communication with upper and lower cavities.

11. A flexible cable connector according to claim 9 wherein one arm portion of each contact is integrally joined to one end of the medial arm portion by a body portion which has an anchoring portion anchoring the contact in the upper, front wall of the housing and the other arm portion is integrally joined to another end of the medial arm portion by a body portion which anchors the contact in the lower rear wall of the housing.

12. A flexible cable connector for effecting electrical connection to respective conductive paths on an end portion of a flexible cable comprising:

an elongate insulating housing having a first cable receiving face and formed with an elongate, cable receiving cavity with a cable receiving mouth opening to the cable receiving face, the cavity having opposite sidewalls extending away from the cable receiving mouth;

a plurality of electrical contacts each comprising an arm having a protuberance adjacent a free end, the contacts being mounted in the housing in a row with respective protuberances adjacent the mouth and spaced a predetermined distance apart from one sidewall, and with respective arms extending across the cavity, inwardly away from the mouth;

an elongate slider having a central pressing portion and actuating portions at respective opposite ends thereof and retaining means mounting the slider in the housing with the pressing portion extending along the cable receiving cavity for reciprocal sliding movement towards and away from the cable receiving mouth between an open, cable admitting position in which the pressing portion is spaced inwardly, remote from the mouth and contact protuberance to permit an end of a flexible cable to be inserted through the mouth into the cable receiving cavity and between the respective protuberances and the one sidewall, and a closed, cable connecting position in which the pressing portion is adjacent the mouth urging the end of an inserted cable and the protuberances relatively together to bring respective conductive paths thereof into electrical engagement with respective contacts, the central pressing portion of the slider remaining wholly within the housing cavity in both the cable admitting and cable pressing positions and throughout the sliding movement therebetween.

13. A flexible cable connector for effecting electrical connection to respective conductive paths on an end portion of a flexible cable comprising:

an elongate insulating housing molded in one piece from plastic and having a first cable receiving face and upper and lower sidewalls spaced apart so as to define between them an elongate, cable receiving cavity opening to respective opposite longitudinal ends of the housing and having a cable receiving mouth opening to the cable receiving face;

a plurality of electrical contacts each having a mounting portion from which two elongate portions extend in side by side relation, spaced a predetermined distance apart to provide between them a cable receiving gap, at least one elongate portion of each contact comprising a resilient arm formed with a protuberance protruding towards a respective other elongate portion of a respective contact, the contacts being mounted in the housing in a row with respective elongate portions extending adjacent respective opposite sides of the cable receiving cavity and with respective gaps opening towards the cable receiving mouth and with at least the protuberance of each contact protruding into the cavity adjacent the mouth;

an elongate slider having a central pressing portion and actuating portions at respective opposite ends thereof and retaining means mounting the slider in the housing with the pressing portion extending along the cable receiving cavity through the gaps between respective elongate portions of each contact for reciprocal sliding movement towards and away from the cable receiving mouth between an open, cable admitting position in which the pressing portion is spaced inwardly, remote from the mouth and contact protuberance to permit a flexible cable to be inserted through the mouth into the cable receiving cavity and gaps between the respective elongate portions, and a closed, cable connecting position in which the pressing portion is adjacent the mouth to press respective conductive paths of the inserted cable into engagement with respective protuberances with resilient flexure of the resilient arm, to effect electrical connection therewith;

the sidewalls being formed at locations adjacent and spaced from respective opposite ends with slots extending away from the cable receiving face so as to define resilient, slider mounting arms at respective opposite longitudinal ends, which mounting arms have one of over-ridable indent and detent means for releasably latching the slider in respective open and closed positions.

* * * * *